US011127381B2

(12) United States Patent
Fredén et al.

(10) Patent No.: US 11,127,381 B2
(45) Date of Patent: Sep. 21, 2021

(54) CONVERTER ARRANGEMENT AND A METHOD FOR INCREASING THE NUMBER OF STRINGS ON A STRING INSTRUMENT

(71) Applicants: Josefin Fredén, Ljungskile (SE); Samuel Fredén, Ljungskile (SE)

(72) Inventors: Josefin Fredén, Ljungskile (SE); Samuel Fredén, Ljungskile (SE)

(73) Assignees: Josefin Fredén, Ljungskile (SE); Samuel Fredén, Ltungskile (SE)

( * ) Notice: Subject to any disclaimer, the term of this patent is extended or adjusted under 35 U.S.C. 154(b) by 0 days.

(21) Appl. No.: 16/967,770

(22) PCT Filed: Feb. 4, 2019

(86) PCT No.: PCT/EP2019/052653
§ 371 (c)(1),
(2) Date: Aug. 6, 2020

(87) PCT Pub. No.: WO2019/154761
PCT Pub. Date: Aug. 15, 2019

(65) Prior Publication Data

US 2020/0365121 A1 Nov. 19, 2020

(30) Foreign Application Priority Data

Feb. 8, 2018 (SE) ..... 1830043-4

(51) Int. Cl.
*G10D 3/12* (2020.01)
*G10D 3/14* (2020.01)

(52) U.S. Cl.
CPC ..... *G10D 3/12* (2013.01); *G10D 3/14* (2013.01)

(58) Field of Classification Search
CPC ..... G10D 3/12; G10D 3/14; G10D 1/085; G10D 1/08; G10D 1/02
See application file for complete search history.

(56) References Cited

U.S. PATENT DOCUMENTS 568,108 A 9/1896 Brown
578,872 A 3/1897 Henlein
(Continued)

FOREIGN PATENT DOCUMENTS

CN 203616977 U 5/2014
FR 002415853 A1 * 8/1979 ..... G10D 1/08
(Continued)

OTHER PUBLICATIONS

International Search Report and Written Opinion in Corresponding PCT Application No. PCT/EP2019/052653 dated May 15, 2019. 10 pages.

(Continued)

*Primary Examiner* — Kimberly R Lockett
(74) *Attorney, Agent, or Firm* — Leason Ellis LLP

(57) ABSTRACT

The present invention relates to a converter arrangement (1) for increasing the number of strings on a string instrument, the converter arrangement comprising; a frame (20) with a base plate (21) and a head (30) with string adjustment screws (31); additional strings (2) attached to the base plate (21) and extending to the head (30) where the strings (2) terminate at the adjustment screws (31) which allow the additional strings (2) to be tuned; means (102) for releasably attaching the converter arrangement to the string side on the string instrument. The present invention also relates to a method for applying the converter arrangement (1) to a string instrument.

14 Claims, 8 Drawing Sheets

(56) References Cited

U.S. PATENT DOCUMENTS

| | | | |
|---|---|---|---|
| 1,618,626 | A | 2/1927 | Altpeter |
| 4,240,319 | A | 12/1980 | Soupios |
| 5,753,838 | A | 5/1998 | Vanga, II |
| 7,659,465 | B1 | 2/2010 | McEwen |

FOREIGN PATENT DOCUMENTS

| | | | |
|---|---|---|---|
| FR | 2415853 | A1 | 8/1979 |
| GB | 257116 | A | 8/1926 |

OTHER PUBLICATIONS

International Preliminary Report on Patentability in Corresponding PCT Application No. PCT/EP2019/052653 dated Aug. 11, 2020. 8 pages.

* cited by examiner

CONVERTER ARRANGEMENT AND A METHOD FOR INCREASING THE NUMBER OF STRINGS ON A STRING INSTRUMENT

CROSS-REFERENCE TO RELATED PATENT APPLICATIONS

This application is a U.S. National Stage Application under 35 U.S.C. § 371 of International Patent Application No. PCT/EP2019/052653, filed Feb. 4, 2019, which claims the benefit of priority of Swedish Patent Application number SE 1830043-4 filed Feb. 8, 2018, both of which are incorporated by reference in their entireties. The International Application was published on Aug. 15, 2019, as International Publication No. WO 2019/154761 A1.

FIELD OF THE INVENTION

The present invention relates to a converter arrangement for increasing the number of strings on a string instrument such as a guitar.

BACKGROUND ART

In order for a stringed instrument to be in tune, the octave point of each string must be aligned with its corresponding octave fret which is located, for example, on the neck of an electric guitar or bass. The octave point of a string is defined by the overall resonant length of the string which is, in turn, defined by the distance between the cross-over point of the string at the nut and the cross-over point of the string at the bridge. As long as the distance between the cross-over points at the nut and the bridge remain constant, the resonant length of the string, and therefore its octave point, also remains constant.

In modern electric guitars, for example, it is realized that the height of each string relative to the neck of the instrument is a matter of personal taste, and many mechanisms have been introduced to permit the height of the strings to be varied as a user may desire. See, for example, U.S. Pat. No. 4,031,799 to Fender. This height adjustment is generally achieved by varying the spacing between the bridge and the body of the instrument by means of, for example, set screws which extend vertically through the bridge sections (also known as drums).

Double-stringed guitars are those provided with a plurality of pairs of strings. Each pair comprises two strings placed close together and played as one string tuned in an octave or in the same note. The pair of strings produces a sound which cannot be achieved by an ordinary single-stringed instrument. See, for example, U.S. Pat. Nos. 1,721,710; 1,819,371; 3,269,247; and 3,344,698. In each of the double-stringed instruments described in the foregoing patents, one end of the strings are terminated on the body after passing over a bridge, and the other ends thereof are terminated by a plurality of tuning keys located on the head of the instrument after passing over a nut.

While a double-stringed guitar is a nice addition to a musician's inventory of instruments, it is only suitable for certain songs and therefore represents a substantial investment. It would therefore be highly desirable if a device could be provided, at relatively low cost, which would permit a musician to readily convert a single-stringed instrument to a double-stringed instrument and back at will. Such a device would clearly save the tremendous costs incident to purchasing a new double-stringed guitar as opposed to converting an existing, perhaps unused single-stringed guitar.

Such a conversion kit should also preferably be readily compatible with existing guitar designs, which would provide a ready market for the kit. The kit should include means for adding the extra strings and terminating the respective ends thereof in the head and body of the instrument over suitable nut and bridge assemblies, as well as means for tuning the added strings.

SUMMARY OF THE INVENTION

In view of the above-mentioned and other drawbacks of the prior art, a general object of the present invention is to provide an improved arrangement for converting a single-stringed instrument to a double-stringed instrument and also to at least partly alleviate the above problems with the prior art. Hence an object of the present invention is to provide a stringed instrument conversion arrangement (1) which permits a conventional single-stringed instrument (e.g., a four string bass or a six string guitar) to be quickly and easily converted to a double-stringed instrument (e.g., an eight or twelve string guitar) with a minimum of parts, modification to the instrument and expense. Another object of the present invention is to provide a converter arrangement (1) for increasing the number of strings (2) on a string instrument (e.g. a six string guitar) to a desired number with a minimum of parts to increase the range of options for playing that instrument.

A further object of the present invention is to have a string instrument with no mounted strings or mounted adjustment screws, where the conversion arrangement (1) could be used to provide the instrument with e.g. 4, 5, 6 strings or more and to als have a possibility e.g. to shift between nylon or steel strings. In order to have further options, it would also be possible to use more than one conversion arrangement (1) on the same string instrument.

According to a first aspect of the present invention, these and other objects are achieved through a converter arrangement (1) for increasing the number of strings (2) on a string instrument, the converter arrangement (1) comprising

- a frame (20);
- a head (30) with string (2) adjustment screws (31), and;
- means for releasably attaching the arrangement (1) to a string instrument.

The present invention is based on the realization that the options for double-stringed instruments today are limited, either a large investment into a purely double-stringed instrument is made, or one can make permanent changes to a single-stringed instrument which may be beloved or desired to use in the normal manner. The inventors have realized that by introducing a frame (20), understood to be load bearing, the converter arrangement (1) may be releasably attached to a string instrument. By having a load bearing frame (20) the risk for the neck of the instrument being converted breaks or cracks is reduced. The converter arrangement (1) is cost-effective, reliable, quickly attached, and provides the ability to use a single-stringed instrument having good acoustic characteristics as a double-stringed instrument without investing in an equally good double-stringed instrument as well. The converter arrangement (1) is moreover low-cost, reliable, and robust. Perhaps more importantly, the converter arrangement (1) may be quickly removed and do not permanently alter the guitar as other methods to convert instruments do e.g. by penetrating the body of a guitar or the like.

According to at least one exemplifying embodiment, the frame (20) comprises two opposite elongated support members (22 and 23) extending from a base plate (21), arranged opposite the head (30), to the head (30) and carrying the load of the frame (20). The opposite elongated support members (22 and 23) should be understood to be arranged opposite each other of a central longitudinal axis of the converter arrangement (1).

The head (30) with string adjustment screws (31) could be placed together with the original adjustment screws of the string instrument or in the opposite end of the frame (20). The base plate (21) will always be placed in the opposite end of the frame (20) compared to the head (30).

According to at least one exemplifying embodiment, the frame (20) comprises a single elongated support member (212) extending from a base plate (211), arranged opposite the head (310), to the head (310) and carrying the load of the frame.

The frame (20) may be made in a single piece or from multiple parts which are attached to each other (FIG. 4*b*).

The elongated support member(s) (212) may be straight, curved or in principle follow any shape. The cross-section of the elongated support member(s) (212) may vary or be constant.

The elongated support member(s) (22, 212) may be mounted on top of the string instrument (FIG. 3*c*), partly on top and under the instrument (FIG. 4*b*) or mainly under the instrument.

According to at least one exemplifying embodiment, the frame (20) is made of wood and/or metal. Alternatively, the frame (20) may be made partly or wholly by plastic.

According to at least one exemplifying embodiment, the converter arrangement (1) comprises strings (2) attached to the base plate (21) and extending to the head (30) where the strings (2) terminate at the adjustment screws (31) which allow(s) the additional strings (2) to be tuned.

According to a second aspect of the present invention, these and other objects are achieved through a method for applying a converter arrangement (1) to a string instrument. The method comprising the steps of:

- providing a converter arrangement (1) for increasing the number of strings (2) on a string instrument comprising a frame (20), a head (30) with string adjustment screws (31), and means (101,102,103) for releasably attaching the arrangement (1) to a string instrument;
- releasably attaching the arrangement (1) to a string instrument;
- arranging strings (2) between a base plate (21) of the frame (20) and extending to the head (30) where the strings (2) terminate at adjustment screws (31) arranged on the head (30).

Objects, effects and features of the second aspect are largely analogous with the first aspect of the invention.

Other objectives, features, and advantages of the present invention will appear from the following detailed disclosure, from the attached dependent claims as well as from the drawings.

BRIEF DESCRIPTION OF THE DRAWINGS

These and other aspects of the present invention will now be described in more detail, with reference to the appended drawings showing at least one example embodiment of the invention, wherein.

DETAILED DESCRIPTION OF EMBODIMENTS OF THE INVENTION

Figure 1A:
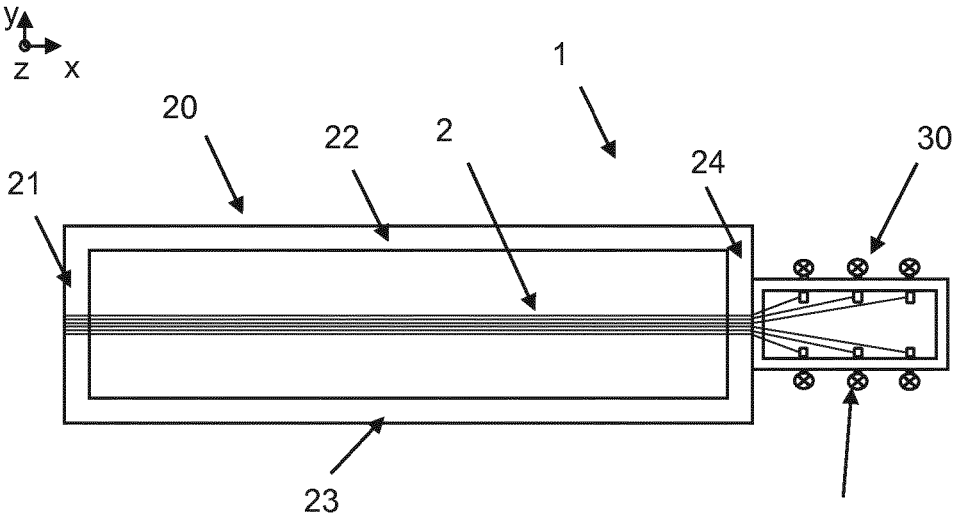
FIGS. 1*a*-1*c* are schematic views of a converter arrangement (1) according to at least one embodiment of the present invention.

In the present detailed description, embodiments of a converter arrangement (1) and method for increasing the number of strings (2) on a string instrument are mainly discussed with reference to views schematically illustrating the principle of the invention according to various embodiments of the invention. It should be noted that this by no means limits the scope of the invention, which is also applicable in other circumstances for instance with other types or variants of frames, instruments, shapes and attachment means than the embodiments shown in the appended drawings. Further, that specific features are mentioned in connection to an embodiment of the invention does not mean that those components cannot be used to an advantage together with other embodiments of the invention. In the drawings, similar, or the same elements are referred to by the same reference numerals. The drawings are merely schematic representations, not intended to portray specific parameters of the invention.

Figure 1B:
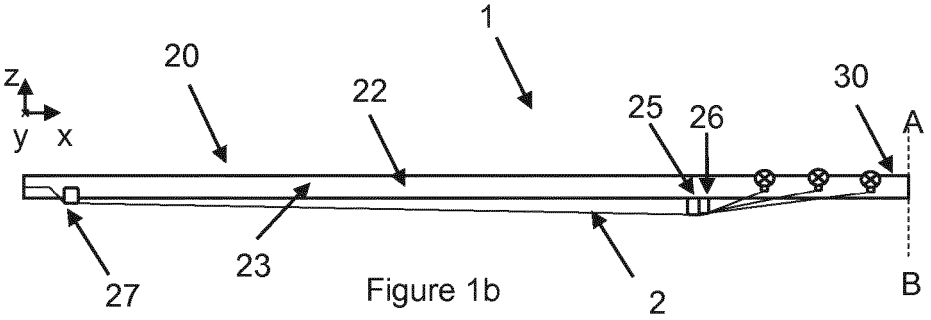
Figure 1C:
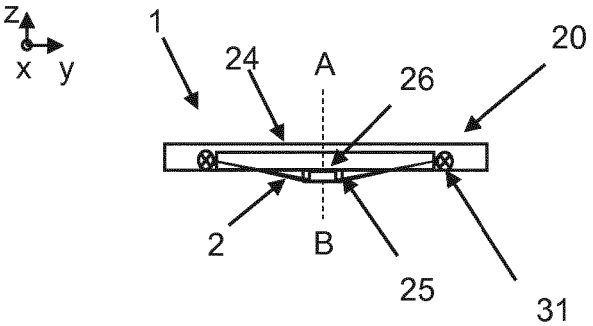

FIGS. 1*a*-1*c* are schematic views of a converter arrangement (1) according to at least one embodiment of the present invention. FIG. 1*a* is a top view, FIG. 1*b* is a side view and FIG. 1*c* is a front view. A coordinate system common in FIGS. 1*a*-1*c* also shows from which direction the converter arrangement (1) is shown.

The converter arrangement (1) comprises a frame (20) and a head (30). The frame (20) and head (30) may be made of any suitable type of material such as wood, plastic or metal, and the frame(s) (20) and head(s) (30) shown in the drawings may have different cross sections for different parts or portions and different cross-sections along a portion or part.

The frame (20) comprises two opposite elongated support members (22, 23) extending from a base plate (21), arranged opposite the head (30), to a head portion (24). The two opposite elongated support members (22, 23) thus carry the load of the frame, created by the tensions in strings (2). The head portion (24) is attached to and supports the head (30). The head may be a part of portion (in the case of a single piece frame) of the frame (20). Alternatively, the head (FIG. 2*a*, FIG. 2*b*, FIG. 2*c*, FIG. 2*d*, FIG. 2*e*) may be a separate part attached to the frame (20).

Also shown in FIGS. 1*a*-1*c* are strings (2) which extend from the base plate (21) of the frame where they may pass through a saddle (27) to the head (30) where they are attached with adjustment screws (31). Alternatively, the strings (2) may just be attached at the head (30) without the need for tuning device(s) (31). The strings (2), see FIG. 1*b*, pass under a part (24) of the frame and rest on a rubber list (25) and a saddle or nut (26). In use, the rubber list (25) may rest against the body of an instrument such as guitar while the saddle or nut (26) holds the strings (2) spaced apart. It is of course understood that the string (2) may be routed differently and achieve the same effect, for example, the string may pass over or through a part (21, 24) of the frame (20) or through drilled holes in a part (21, 24) of the frame (20).

The strings (2) extend from the base plate (21) where they are attached, to the head (30), under the head portion part (24) as seen in FIG. 1*b*, to the adjustment screws (31). There are many ways to attach the strings (2) to the frame (1) at the base plate (21). The strings (2) may be threaded through holes in the base plate (21) or the head portion part (24). The strings (2) may have a knot at the end such that the knot blocks the passage of the strings (2) through their respective holes in the base plate (21) or the head portion part (24), or be locked by a screw that is located in an adjacent hole, for each respective hole in the base plate (21) or the head portion part (24). Alternatively, the strings (2) may be tied around the base plate (21).

Figure 2A:
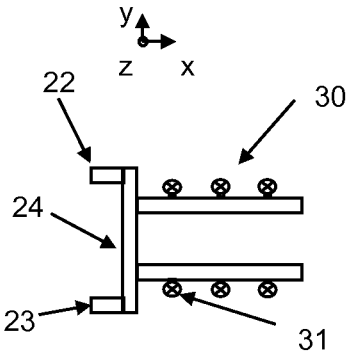
FIGS. 2*a*-2*e* are different views of heads (30) with string adjustment screws (31) suitable for use with the present invention.
Figure 2B:
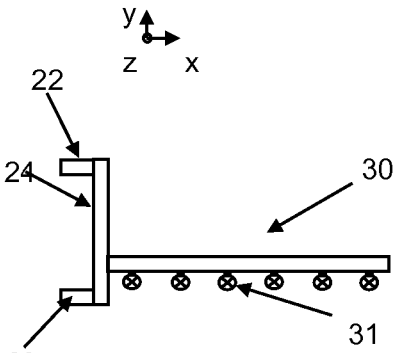
Figure 2E:
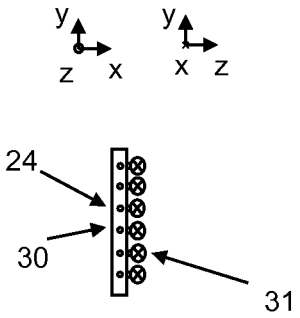
Figure 2C:
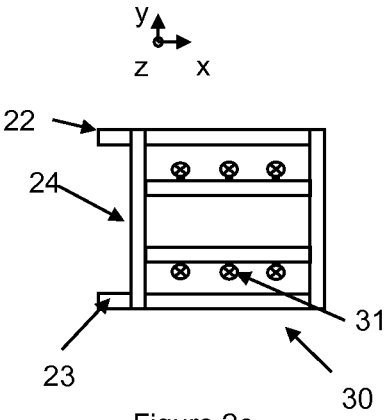
Figure 2D:
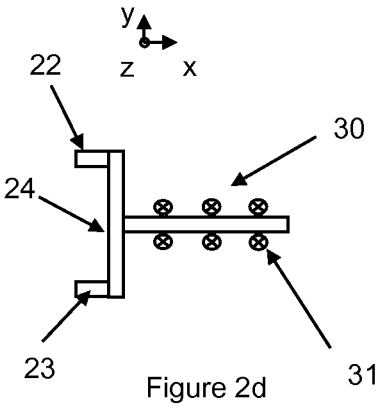

FIGS. 2*a*-2*e* show different embodiments of heads (30) suitable to use with the converter arrangement (1). FIG. 2*a* shows a head with two legs having three adjustment screws each. FIG. 2*b* shows a head with six adjustment screws arranged on a single leg. FIG. 2*c* shows the head being reinforced by the frame that continues around the head. FIG. 2*d* shows that the head has a leg with three adjustment screws arranged on each side of the single leg. FIG. 2*e* shows adjustment screws located directly on a part of the frame, e.g. corresponding to part 24 in FIG. 1*a*. FIGS. 2*a*-2*e* are just examples which show how a head with adjustment screws could appear in combination with the invention. Other variants are of course possible and within the scope of the invention, for example, a larger or smaller number of adjustment screws based on the number of strings (2) on the instrument to which the invention is to be used.

Figure 3A:
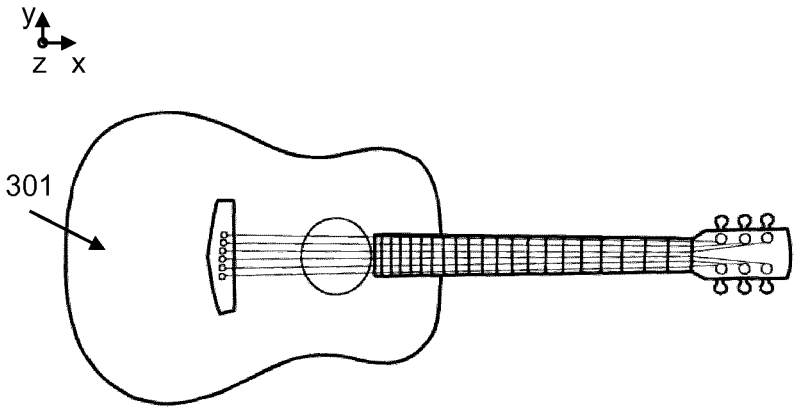
FIG. 3*a* shows a typical six stringed guitar.
Figure 3B:
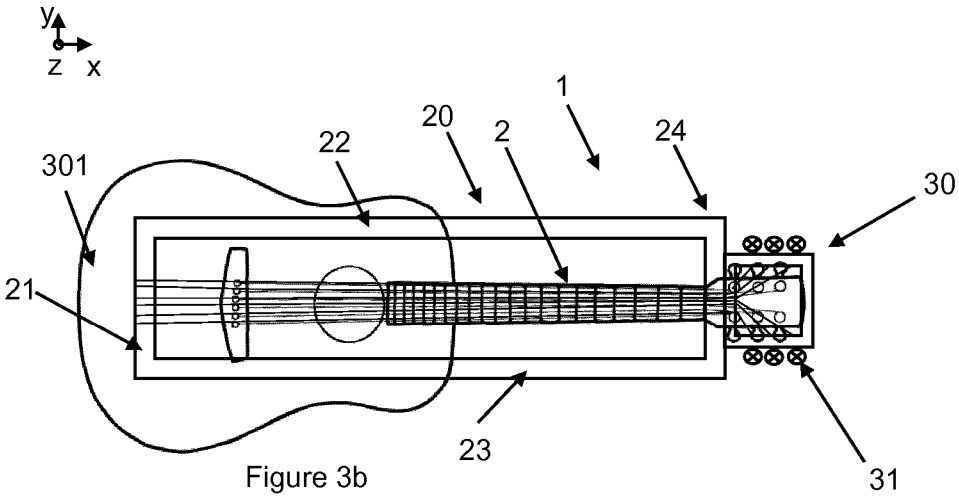
FIGS. 3*b* and 3*c* are different views of a converter arrangement (1) according to at least one embodiment of the present invention applied to the six stringed guitar of FIG. 3*a*.
Figure 3C:
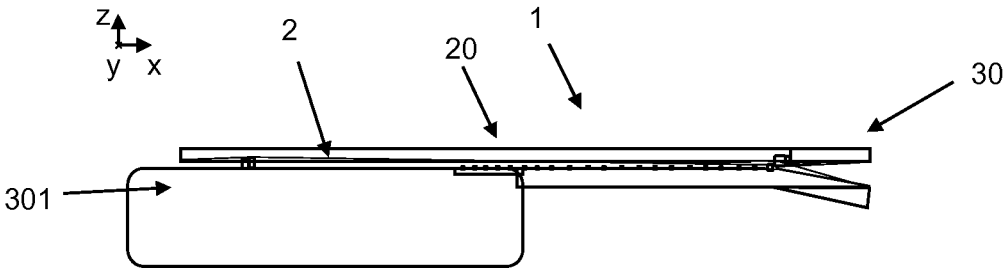

Referring to FIGS. 3*a*-3*c*, firstly, in FIG. 3*a* a typical six-stringed guitar is shown without the converter arrangement (1), which is to be contrasted with FIGS. 3*b* and 3*c* where a converter arrangement (1) is shown placed on the guitar without a fastening device. The coordinate system shows the orientation. Note that the strings (2) of the converter arrangement (1) are arranged parallel to the strings of the guitar, advantageously they should form double pairs. The strings (2) of the invention are in this example placed above the strings of the guitar. In some cases the nut and/or saddle of the guitar may be replaced from one with six slots to one with twelve slots so that the strings (2) of the converter arrangement (1) are more easily arranged in the double pair configuration. FIG. 3*b* shows how the strings (2) of the invention go from the short side of the frame (21), and then on the guitar's saddle (303) to be parallel to the guitar strings to the guitar nut. In some cases, a capo can be used on any string (2) or set of strings (2) to adapt the tuning of the guitar as the length of the strings (2) of the guitar and the converter arrangement may have different lengths.

Figure 4A:
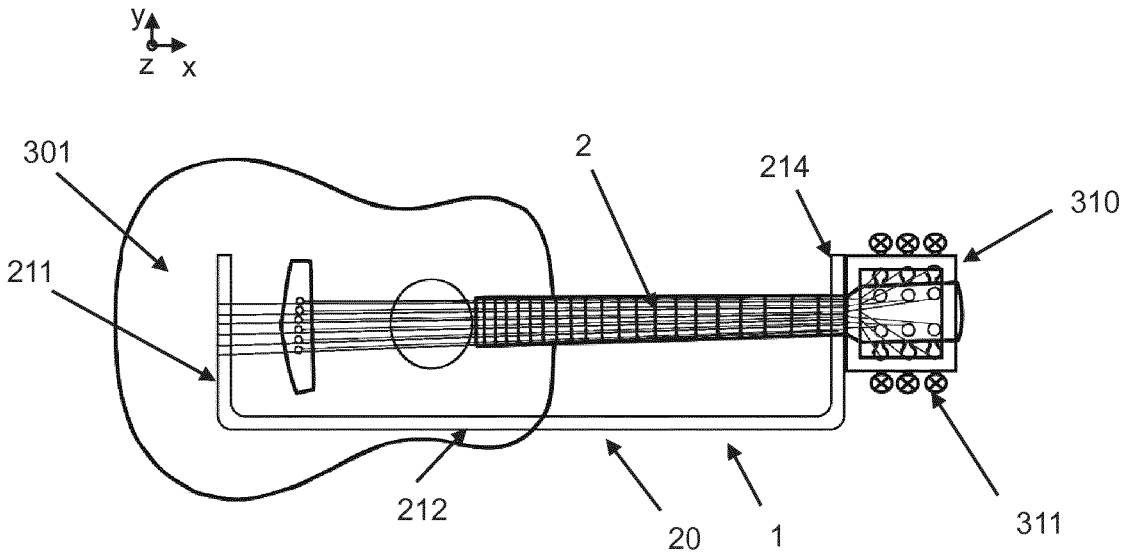
FIGS. 4*a* and 4*b* are schematic views of a converter arrangement (1) according to at least one alternative embodiment of the present invention.
Figure 4B:
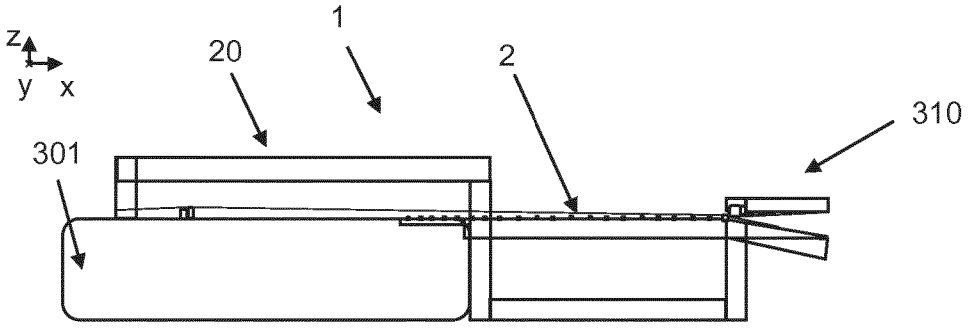

FIGS. 4*a* and 4*b* are schematic views of a converter arrangement (1) according to at least one alternative embodiment of the present invention. In this alternative embodiment the frame (20) comprises a single elongated support member (212) extending from a base plate (211), arranged opposite the head (310), to the head (310) and carrying the load of the frame (20). This alternative embodiment may allow a musician to more easily reach the string (2). In yet another alternative version, not shown, the converter arrangement may comprise a head on each longitudinal side of the frame (20).

FIG. 4*b* shows another alternative design of the converter arrangement (1) where the frame (20) extends in the z-direction. This enables an improved aesthetic of the converter arrangement but also avoids problems with volume and microphone controls which could inhibit a musician's free hand movement most commonly found on electric guitars.

The skilled person realizes that there are many embodiments possible within the scope of the invention for example with smooth flowing shapes of a frame (20) which can hold strings (2) to a head (310) and be attached to a guitar.

Figure 5A:
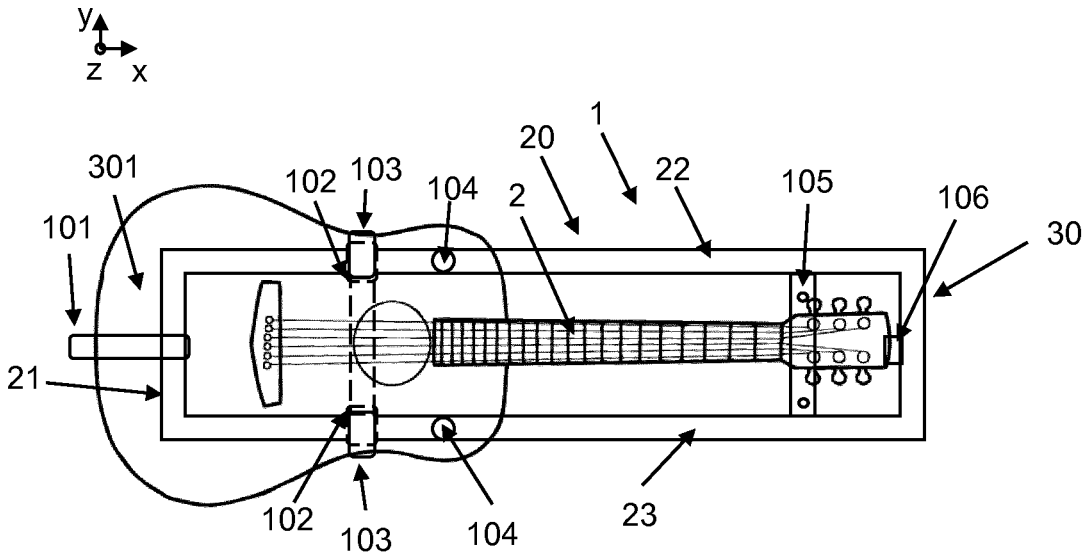
FIGS. 5*a* and 5*b* are different views of a converter arrangement (1) according to at least one embodiment of the present invention applied to a six stringed guitar.
Figure 5B:
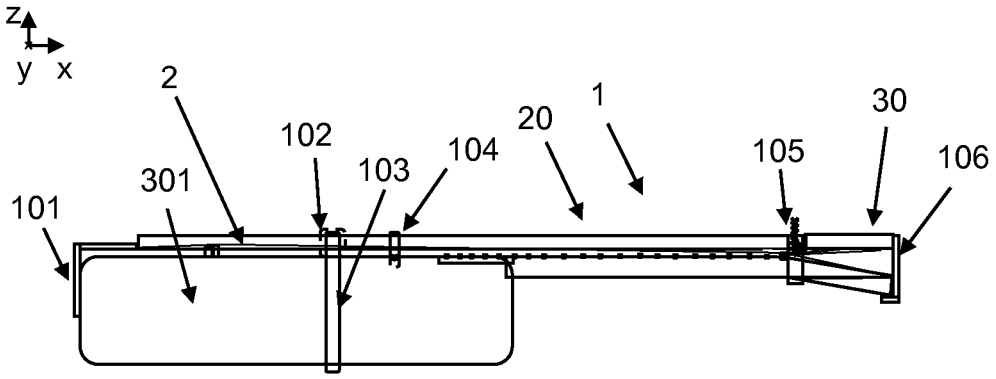

FIGS. 5*a* and 5*b* show attachment means for the converter arrangement (1). Hence it should be noted that various ways of attaching the converter arrangement (1) to the guitar are shown, and not all of these attachment means described are required to utilize the converter arrangement (1) for its purpose. Not all of the shown attachment means are required, one, two or three may be suitable to use. The converter arrangement (1) shown in FIGS. 5*a* and 5*b* comprises attachment means in the form of a belt and a buckle (101) attached to the short edge of the frame (20), corresponding to a base plate (21), and which would run and be attachable to the shoulder strap button of a guitar. However, all guitars may not have a button for the shoulder strap. Hence, the buckle (101) may instead run to strap (103) explained below or be attached with a hook-shaped bracket on the back of the guitar (301).

Another option is to attach a snap-fit (102) with a shape complimentary to the frame (20). The snap-fit (102) can be attached to a strap around the body of the guitar. However, there are other ways to attach the snap-fit (102), for example using magnets placed inside the body (301) of the guitar and having magnets on the snap-fit (102). Another attachment means is a strap (103) attached to the long sides of the frame (20). The strap or straps (103), in case there are two straps (103) extending from each side of the frame (20), may be attached to or at the back of the guitar with a buckle and they can be pulled to tension manually to lock the frame (20) in place. The straps (103) can be pulled around the guitar's body in many different ways, for example by merging with the belt and buckle (101). As indicated above, magnets (104) may be arranged inside the body (301) of the guitar and on the frame (20) so that the frame (20) is pressed against the guitar through the magnetic field that arises through the body (301) of the guitar. Head attachment means (105) are detailed in FIGS. 6*a* and 6*b*. A hook-shaped bracket (106) may be arranged to be seated against the head of the guitar. Any straps may be elastic or inelastic. The straps may have Velcro strips to attach them to each other and/or the frame (20).

Figure 6A:
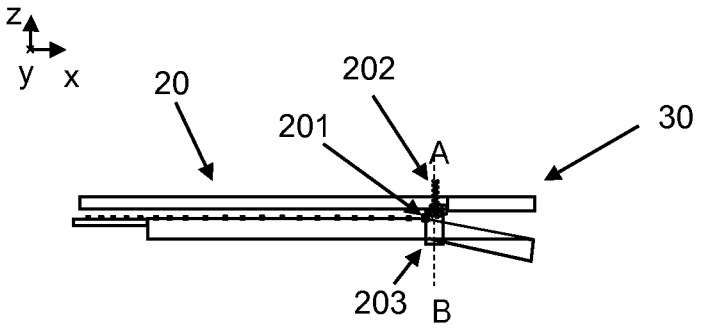
FIGS. 6*a* and 6*b* are detailed views showing attachment means for the converter arrangement (1).
Figure 6B:
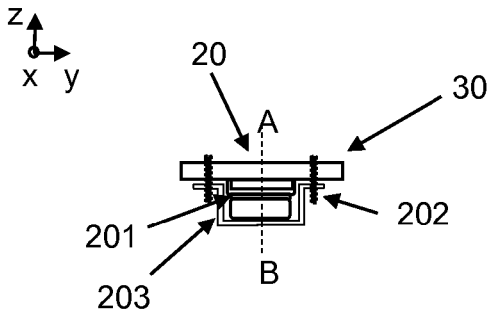

FIGS. 6*a* and 6*b* are detailed views showing head attachment means for the converter arrangement (1). Reference number (201) refers to the nut of the guitar. Two screws (202) may be used to attach the frame (20) to a head bracket (203). The head bracket (203) may be made of different materials and have different shapes. This is just an example of one design. Another example may be that the screws are replaced by some kind of spring or snap-fit device. In some cases, a regular capo can act as a head bracket. Yet another example would be that either one of the screws (202) are replaced with an axle (which could be spring-loaded) that holds the head bracket (203) to the frame (20) and can rotate with a pivot axis parallel to the guitar neck. The head bracket (203) would then be rotated around the guitar neck until it tightens, and then it could be locked with the remaining screw (202) for example. Further, the frame (20) may be attached to the part of the original strings (2) of the string instrument that are located between the original nut and the original adjustment screws of the string instrument.

Figure 7A:
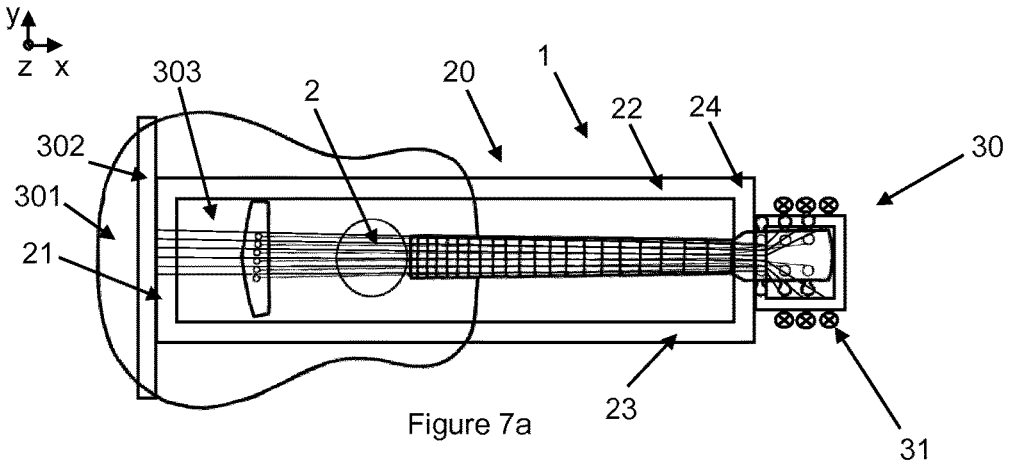
FIGS. 7*a*-7*c* are different views of a converter arrangement (1) according to at least one embodiment of the present invention applied to a six stringed guitar.
Figure 7B:
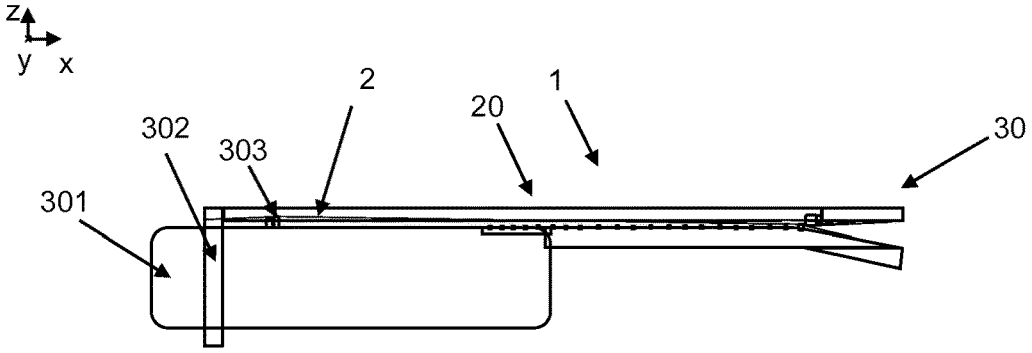
Figure 7C:
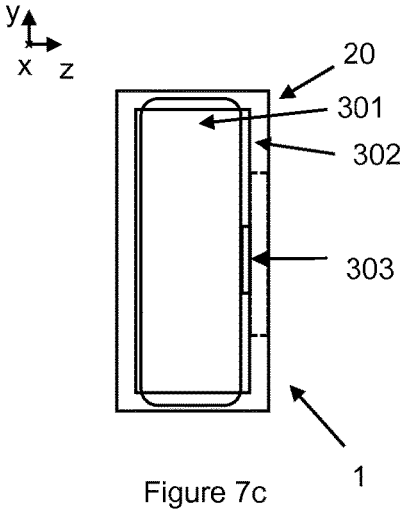

FIGS. 7*a*-7*c* are three views of a converter arrangement (1) according to at least one embodiment of the present invention applied to a six stringed guitar. The converter arrangement in FIGS. 7*a*-7*c* shows an alternative means for releasably attaching the converter arrangement (1) to a guitar (FIG. 3*a*).

A guitar body (301) has a typical shape with a wider rear than middle. The converter arrangement (1) may comprise a bracket (302) having a hole which is shaped as the rear of the guitar, such that the guitar body (301) can be inserted into the hole and thereby lock the rear of the frame (20) to the guitar. The bracket (302) may be made of a soft material, or the hole of the bracket (302) may be lined with a soft material.

Although the frame(s) (20) shown in the drawings have had a generally rectangular shape with two elongated members (22, 23) which bear the load caused by the strings (2) in tension it should be noted that the present invention could make use of any suitable load-bearing frame (20) such as a triangular, oval or otherwise generally shaped frame. Moreover the number of elongated members which bear the load could be a single one, as shown in FIGS. 4*a* and 4*b*, or three or more.

Even though the invention has been described with reference to specific exemplifying embodiments thereof, many different alterations, modifications and the like will become apparent for those skilled in the art. Variations to the disclosed embodiments can be understood and effected by the skilled addressee in practicing the claimed invention, from a study of the drawings, the disclosure, and the appended claims. Furthermore, in the claims, the word "comprising" does not exclude other elements or steps, and the indefinite article "a" or "an" does not exclude a plurality.

Figure 8:
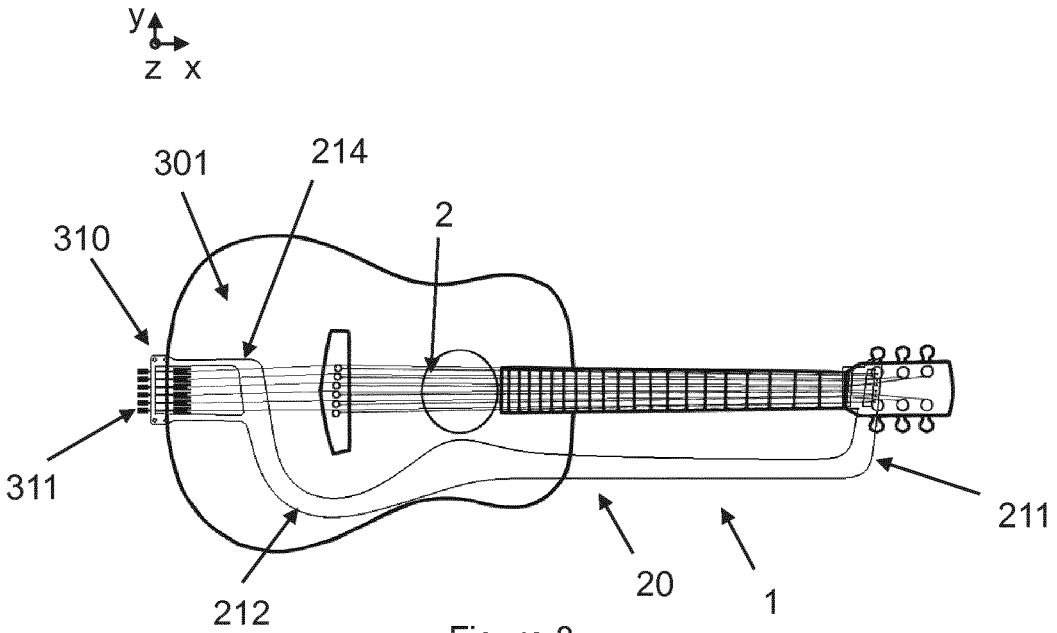
FIG. 8 shows a principle view of a string instrument with a converter arrangement (1) with a single elongated support member (212), where the head (310) with string adjustment screws (311) are placed in the opposite end of the frame in relation to the original adjustment screws of the string instrument.

As can be seen from FIG. 8, a converter arrangement (1) with a single elongated support member (212) can be placed on a string instrument in such a way that the head (310) with string adjustment screws (311) are placed in the opposite end of the frame in relation to the original adjustment screws of the string instrument, and where the base plate (211) is placed together with the original adjustment screws of the string instrument.

The converter arrangement (1) could be made from multiple parts, where the single elongated support member (212), the base plate (211) and the head (310) are mounted together, but the single elongated support member (212), the base plate (211) and the head (310) could also be fully integrated into one piece.

The invention claimed is:

1. A converter arrangement for increasing the number of strings on a guitar having a string side, the converter arrangement comprising;

a frame having a short side and a base plate and a head with string adjustment screws additional strings attached to the base plate and extending to the head where the additional strings terminate at the string adjustment screws which allow the additional strings to be tuned;

means for releasably attaching the converter arrangement to the string side of the guitar so that the additional strings extend from the short side of the frame over a saddle of the guitar to a guitar nut, when the converter arrangement is attached to the guitar.

2. A converter arrangement according to claim 1, wherein the frame comprises two opposite elongated members extending from the base plate, arranged opposite to the head, and carrying the load of the frame created by the tensions in the additional strings.

3. A converter arrangement according to claim 1, wherein the frame comprises a single elongated support member extending from the base plate, arranged on one side of the head and carrying the load of the frame created by the tensions in the additional strings.

4. A converter arrangement according to claim 3 wherein the single elongated support member, the base plate and the head are fully integrated into one piece.

5. A converter arrangement according to claim 2, wherein the two opposite elongated members have a curved configuration in z-direction, so that the part of the two opposite elongated members that are parallel to the neck of the guitar will be located in z-direction below the neck of the guitar.

6. A converter arrangement according to claim 3, wherein the single elongated support member has a curved configuration in z-direction, so that the part of the single elongated member that is parallel to the neck of the string instrument will be located in z-direction below the neck of the string instrument.

7. A converter arrangement according to claim 3, wherein the single elongated support member has a curved configuration in z-direction, so that the main part of the single elongated support member will be located in z-direction below the guitar.

8. A converter arrangement according to any of claim 1, wherein the means for releasably attaching the arrangement to the guitar comprises at least one of, a belt and buckle; a strap; a Velcro attachment strip; an elastic band; a snap-fit or magnets.

9. A converter arrangement for increasing the number of strings on a string instrument, the converter arrangement comprising;

a frame with a base plate and a head with string adjustment screws;

additional strings attached to the base plate and extending to the head where the strings terminate at the adjustment screws which allow the additional strings to be tuned;

means for releasably attaching the converter arrangement to the string side on the string instrument, wherein the frame comprises a single elongated support member extending from the base plate, arranged opposite to the head, and carrying the load of the frame created by the tensions in strings, wherein the single elongated support member has a curved configuration in z-direction, so that the part of the single elongated member that is parallel to the neck of the string instrument will be located in z-direction below the neck of the string instrument.

10. The converter arrangement of claim 9 wherein the single elongated support member, the base plate and the head are fully integrated into one piece.

11. A converter arrangement for increasing the number of strings on a string instrument, the converter arrangement comprising;

a frame with a base plate and a head with string adjustment screws;

additional strings attached to the base plate and extending to the head where the strings terminate at the adjustment screws which allow the additional strings to be tuned;

means for releasably attaching the converter arrangement to the string side on the string instrument, wherein the frame comprises a single elongated support member extending from the base plate, arranged opposite to the head, and carrying the load of the frame created by the tensions in strings, wherein the single elongated support member has a curved configuration in z-direction, so that the main part of the single elongated support member will be located in z-direction below the string instrument.

12. The converter arrangement of claim 11 wherein the single elongated support member, the base plate and the head are fully integrated into one piece.

13. A converter arrangement according to claim 4, wherein the single elongated support member has a curved configuration in z-direction, so that the part of the single elongated member that is parallel to the neck of the string instrument will be located in z-direction below the neck of the string instrument.

14. A converter arrangement according to claim 4, wherein the single elongated support member has a curved configuration in z-direction, so that the main part of the single elongated support member will be located in z-direction below the guitar.

* * * * *